US008984827B2

(12) United States Patent
Schreer

(10) Patent No.: US 8,984,827 B2
(45) Date of Patent: Mar. 24, 2015

(54) INSULATING FORMWORK BLOCK

(75) Inventor: Paul Schreer, Rosbruck (FR)

(73) Assignee: Euromac 2, Folschviller (FR)

( * ) Notice: Subject to any disclaimer, the term of this patent is extended or adjusted under 35 U.S.C. 154(b) by 0 days.

(21) Appl. No.: 13/811,471

(22) PCT Filed: Jul. 11, 2011

(86) PCT No.: PCT/FR2011/051648

§ 371 (c)(1),
(2), (4) Date: May 9, 2013

(87) PCT Pub. No.: WO2012/010773

PCT Pub. Date: Jan. 26, 2012

(65) Prior Publication Data

US 2013/0277531 A1 Oct. 24, 2013

(30) Foreign Application Priority Data

Jul. 22, 2010 (EP) ..... 10305813

(51) Int. Cl.

| | |
|---|---|
| ***E04C 1/40*** | (2006.01) |
| ***E04B 2/86*** | (2006.01) |
| ***E04G 9/02*** | (2006.01) |
| ***E04B 2/32*** | (2006.01) |

(Continued)

(52) U.S. Cl.

CPC ..... *E04C 1/40* (2013.01); *E04B 2002/0252* (2013.01); *E04B 2/8617* (2013.01); *E04G 9/02* (2013.01); *E04B 2/32* (2013.01); *E04B 2/40* (2013.01); *E04B 2002/0223* (2013.01); *E04B 2002/0245* (2013.01)

USPC ..... 52/309.15; 52/426

(58) Field of Classification Search

CPC ..... E04C 1/40; E04B 2/40; E04B 2/8617; E04B 2002/0252

USPC ..... 52/309.12, 309.15, 309.17, 425, 426

See application file for complete search history.

(56) References Cited

U.S. PATENT DOCUMENTS

| | | | | |
|---|---|---|---|---|
| 1,441,362 | A | 1/1923 | Malcolm | |
| 4,574,550 | A * | 3/1986 | Maschhoff | 52/405.3 |
| 6,151,856 | A * | 11/2000 | Shimonohara | 52/426 |
| 7,739,845 | B2 * | 6/2010 | Kennedy | 52/405.3 |

(Continued)

FOREIGN PATENT DOCUMENTS

| | | |
|---|---|---|
| DE | 200 03 380 U1 | 4/2000 |
| FR | 2 132 597 A1 | 11/1972 |

(Continued)

OTHER PUBLICATIONS

International Search Report issued in corresponding application No. PCT/FR2011/051648 mailed Sep. 26, 2011.

*Primary Examiner* — Michael Safavi

(74) *Attorney, Agent, or Firm* — Carter, DeLuca, Farrell & Schmidt, LLP

(57) ABSTRACT

The present disclosure relates to an insulating formwork block, including an inner wall, and an outer wall connected to the inner wall by connection and/or reinforcement means, the outer wall being thicker than the inner wall. The insulating formwork block is characterized in that the outer wall consists of the first element attached to the inner wall, and a second element made of an insulating material applied to the first element, and in that the second element is provided in the form of a slide which is applied to the first element by a slider and which is L-shaped. The invention can be specifically used in the field of manufacturing insulating formwork blocks.

10 Claims, 7 Drawing Sheets

(51) Int. Cl.
*E04B 2/40* (2006.01)
*E04B 2/02* (2006.01)

(56) References Cited

U.S. PATENT DOCUMENTS

2013/0269275 A1* 10/2013 Ryan ..... 52/426

FOREIGN PATENT DOCUMENTS

| | | | |
|---|---|---|---|
| FR | 2 531 988 | A1 | 2/1984 |
| FR | 2 556 387 | A1 | 6/1985 |
| FR | 2 594 158 | A1 | 8/1987 |
| FR | 2 869 926 | A1 | 11/2005 |
| WO | 03/046310 | A2 | 6/2003 |

* cited by examiner

INSULATING FORMWORK BLOCK

TECHNICAL FIELD

The field of the present invention is that of insulating formwork blocks, used for the making of a wall by casting of material such as concrete. Its subject is such a formwork block.

BACKGROUND OF RELATED ART

A formwork block is classically comprised of two insulating elements spaced apart and connected by a structure, preferably a metal one. For reasons of heat and sound, it is advantageous to use polystyrene foam. This material is used in the rest of the specification, but only for illustrative purposes.

One is familiar from FR-A-2 132 597 with a method of fabrication of a wall by formwork, using a lost casing in the form of hollow assembled building blocks, and in which concrete is poured. Even so, such a formwork still requires an external insulation.

Furthermore, FR-A-2 556 387 specifies a construction element designed to form an insulating formwork to make a wall by pouring concrete into it. This block has a set of regularly spaced apertures to accommodate rods for positioning the blocks relative to each other. Moreover, the vertical edges have a means of assembly with another adjacent block.

Finally, FR-A-2 531 988 discloses an insulating formwork with different component modules, namely, a module of normal size, a half-module to allow for the staggering between two courses, an end module, and a half-end module.

Even so, one of the problems involved in the formwork blocks is that the two elements making up a formwork block need to have a sufficient mechanical strength to resist the load and the pressure created by the poured material. Thus, this is characterized by the use of a particularly costly insulating material. Furthermore, in order to further augment the insulation for a structure in which such a block is used, it is desirable to increase the thickness of the element that is located on the outside. This, then, results in a great increase in the material cost, since the outer element is contiguous, and thus made from one and the same material. Another problem caused by the increase in asymmetric material is the formation of residual thermal deformations. The cooling time is also greatly increased.

In order to obtain a structure resistant to moisture, U.S. Pat. No. 1,441,362 describes a hollow construction block comprised of two pieces, assembled together, of such shape that when assembled they define both a horizontal conduit and a vertical conduit for air passage. This disclosure, however, is not adapted to insulating formworks, which need to guarantee the proper flowing and filling of the concrete, as well as resist the pressure created by the mass of poured material.

DE 200 03 380 discloses a formwork block having two walls, one of them comprising an element applied by a slider. The lack of an end stop for this slider, however, has the consequence that the weight of the outer surfacing may result in a progressive downward movement of said element, since it is not supported by the rest of the block.

FR 2 594 158 discloses a device for fixation of a layer of insulator on cinderblocks. The layer of insulator is placed against the cinderblock thanks to projecting tenons, cooperating with grooves made in the cinderblocks. The vertical support here is provided only by the cross section of the tenons, in the plane of the wall, which can prove to be inadequate. Furthermore, the grooves emerge into the cavity receiving the concrete, which can be a cause of leakage of material.

The purpose of the present invention is to remedy at least some and preferably all of these drawbacks by proposing a formwork block having enhanced insulating capabilities, a low manufacturing cost, and sufficient mechanical strength to support the poured material.

SUMMARY

Toward this end, the subject of the invention is an insulating formwork block, comprising an inner wall as well as an outer wall, connected to the inner wall by means of connection and/or reinforcement, said outer wall being thicker than the inner wall. This formwork block is characterized in that the outer wall is composed of a first element, fixed to the inner wall, and a second element of insulating material, applied to the first element, and in that the second element takes the shape of a slide applied to the first element by means of a slider and having an L shape.

BRIEF DESCRIPTION OF THE DRAWINGS

The invention will be better understood thanks to the following description, which refers to a preferred embodiment, given as a nonlimiting example and explained with reference to the appended schematic drawings, in which.

DETAILED DESCRIPTION

Figure 1:
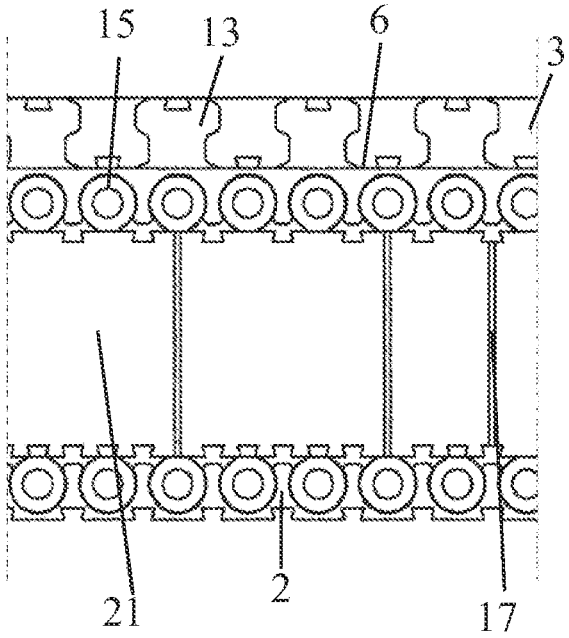
FIG. 1 is a front view of a formwork block according to the invention, without the slide.
Figure 2:
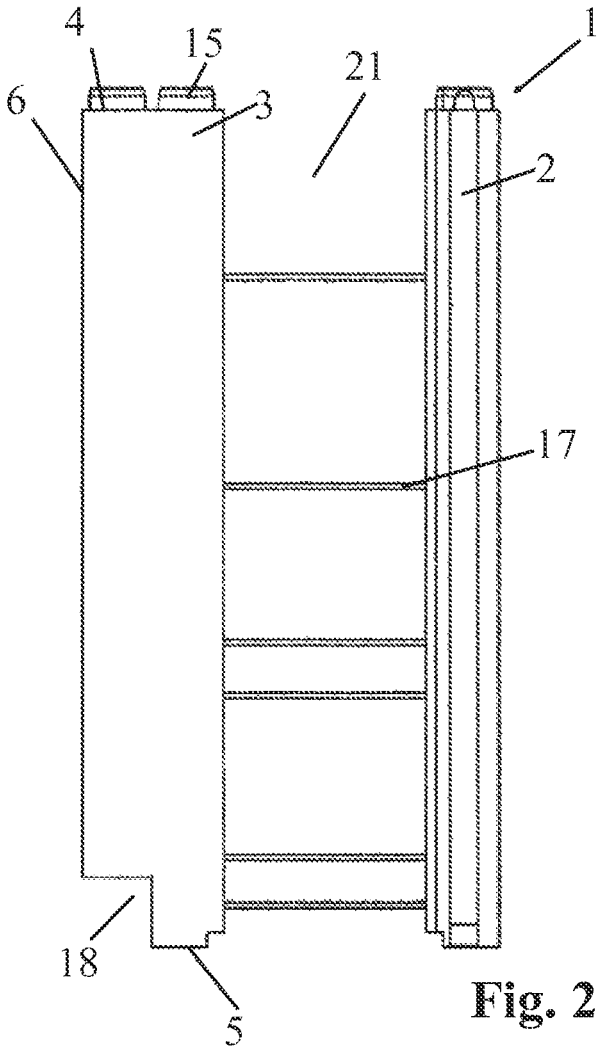
FIG. 2 is a side view corresponding to FIG. 1.

The subject of the invention is an insulating formwork block 1, comprising an inner wall 2 as well as an outer wall 20, connected to the inner wall 2 by connection and/or reinforcement means 17, said outer wall 20 being thicker than the inner wall 2. According to the invention, the outer wall 20 is composed of a first element 3, fixed to the inner wall 2, and a second element 7 of insulating material, applied to the first element 3.

Preferably, the second element 7 of insulating material is constituted of a foam. The first element 3 has an upper surface 4, a lower surface 5, and an exterior surface 6, said first element 3, the second element 7, as well as the inner wall 2 being made of at least especially thermal insulating and soundproofing material, preferably of foam, such as expanded polystyrene.

To enable the forming, the first element 3 is connected to the inner wall 2 by connection and/or reinforcement means 17. A space 21 is thus created between the first element 3 and the inner wall 2, in which concrete or another construction material can be poured. The means of connection and/or reinforcement 17 maintain the first element 3 and the inner wall 2 against each other, making it possible to stabilize the assembly, during the pouring of the concrete and at other times. The first element 3 is made of insulating material, yet even so it is sufficiently dense to support the weight and the pressure of the poured material. In one preferred embodiment, this can be polystyrene having a density of 30 kg/m$^3$. In the illustrated embodiment, the thickness of the first element 3 is greater than that of the inner wall 2, to guarantee a good quality of insulation.

Again according to the invention, the second element 7 takes the form of a slide 7 applied to the first element 3 by means of a slider and having an L shape. Moreover, advantageously, the first element 3 has a shape complementary to this L, such that said slide 7 can slide against the first element 3 by a first vertical branch 8 of the L, until it is locked by a second horizontal branch 9 of the L. The first vertical branch 8 of the L by which the slide 7 slides along the first element 3 as it is being mounted on the latter thus corresponds approximately to the slider. The second branch 9 forms an abutment beneath the first element 3.

In the described embodiment, the slider is linear and parallel to the facade formed by the stacking of insulating formwork blocks 1. This slider is realized by form fitting between the first element 3 and the slide 7.

The slide 7 is preferably made of polystyrene foam and, since the mechanical strength is provided by the first element 3, the density of the material composing the slide 7 can be less, thus reducing the cost of the insulating formwork block 1. This slide 7 is thus advantageously made of a different material, preferably a material less mechanically strong than the material used for the first element 3. The slide 7 is mounted on the first element 3 by a translatory movement, guided by the slider. This slider is preferably vertical in the working position of the formwork block 1. The sliding is done along the outer surface 6 of the first element 3, and the slide 7, as well as the block 1, thus each have shapes able to cooperate in the manner of a slider. In one variant embodiment of the invention, not shown in the appended drawings, the slider is horizontal once the insulating formwork blocks 1 have been installed.

The slider allows a movement in a plane parallel to the outer surface 6 of the first element 3, which corresponds to the plane of the facade constructed by the stacking of insulating formwork blocks 1. Moreover, the slider also enables holding the slide 7 perpendicularly to the plane in which it allows the movement. The slide 7 is thus mounted against the first element 3 in a linear translatory movement parallel to the wall being created.

According to one advantageous characteristic, the slide 7 of L shape, comprising the second element 7, is delimited, at the upper part of the vertical branch of the L, by an upper surface 10, and at the lower part of this branch, corresponding to the horizontal branch of the L, by a lower surface 11, these two surfaces being joined by a vertical outer surface 12, the lower surface 11 of the slide 7 having a length greater than that of the upper surface 10 of said slide 7, and the inner surface 14 of said vertical wing of the L, perpendicular to the upper surface 10 of the slide 7 and parallel to the outer surface 12, extends as far as a horizontal wall 11', parallel to the lower surface 11 of the horizontal branch of the L and determining the thickness of the latter.

As a result, the contact between the slide 7 and the first element 3 occurs by placing in contact the outer surface 6 of the first element 3 and the inner surface 14 of the vertical wing of the L forming the slide 7. Thus, the slider is arranged, on the one hand, at the level of the inner surface 14 of the slide 7 and, on the other hand, on the outer surface 6 of the first element 3. The horizontal wing of the slide 7 of L shape, constituting the second element 7, extends into a recess 18 of the first element 3, having a corresponding complementary shape. The first element 3 can thus accommodate the corresponding part of the horizontal wing of the slide 7, i.e., the part 9 of the latter.

Thus, after installation of insulating formwork blocks 1 one on the other, a slide 7 of L shape can be in contact, at least by a portion of its lower surface 11, with the upper surface 4 of another first element 3 situated beyond the lower surface 11 of the slide 7. In fact, on the one hand, the lower surface 5 of the first element 3 and the lower surface 11 of the slide 7, placed side by side, and on the other hand the upper surface 4 of the first element 3 and the upper surface 10 of the slide 7 placed side by side constitute the same surface. The upper surface 4 of the first element 3 is larger than its lower surface 5, which allows the upper surface 4 of the first element 3 and the lower surface 11 of the slide 7 to be in overlapping contact.

In a structure where the insulating formwork blocks 1 are stacked one on another, it is thus never necessary to provide a support to hold the slide 7 of the lowermost course.

Advantageously, the slider is in the shape of a dovetail connection 13 between an inner surface 14 of the slide 7 forming the second element 7 and the outer surface 6 of the first element 3, in the plane of which the dovetail 13 allows a translatory movement. Thus, among other things, the slider is able to both guide the slide 7 when it is being mounted on the first element 3 and prevent the pulling of the slide perpendicular to its inner surface. It is thus possible to cut off the insulating formwork block 1 and, more particularly, the first element 3, without thereby separating the slide 7 from the first element 3.

According to another characteristic of the invention, the total height of the first element 3, i.e., the distance separating the lower surface 5 and the upper surface 4 of the first element 3, is equal to the height of the slide 7 constituting the second element 7, and thus corresponding to the length of the vertical branch of the L, i.e., to the distance separating the lower surface 11 and the upper surface 10 of the slide 7. Thus, when insulating formwork blocks 1 are stacked one on another, the upper surface 10 of the slide 7 and the upper surface 4 of the first element 3 are in the same plane, thus forming a sole plane of support for another first element 3 or another insulating formwork block 1.

Finally, according to a particularly advantageous characteristic of the invention, the upper surface 10 of the slide 7 and the upper surface 4 of the first element 3 have a first geometrical pattern 15, able to cooperate with a second geometrical pattern 16 arranged on the lower surface 11 of the slide 7 and the lower surface 5 of the first element 3. In the embodiment, this first geometrical pattern 15 is a set of ribs in the form of crowns regularly spaced apart, the second geometrical pattern 16 being in the form of a corresponding set of grooves. Thus, an insulating formwork block 1 can be correctly positioned with respect to a similar insulating formwork block 1 with which it makes contact.

In the embodiment illustrated, the first geometrical pattern 15 and the second geometrical pattern 16 are arranged in the form of parallel rows. The upper surface 4 of the first element 3 has a width corresponding to two rows, as well as the lower surface 11 of the slide 7. The lower surface 5 of the first element has a width corresponding to one row, as well as the upper surface 10 of the slide 7.

According to a supplemental characteristic of the invention, the slider is such that when the slide 7 arrives in abutment against this slider, the lower surface 11 of the slide 7 and the lower surface 5 of the first element 3 are situated in the same plane. Thus, once the slide 7 has slid against a first element 3 and arrived in abutment, and in a situation where the insulating formwork blocks 1 are stacked, the slide can be completely blocked in the movement allowed by the slider in one direction, by the second horizontal branch 9 forming the abutment of the slider when it is located in the recess 18, and in the other direction by the upper surface 4 of another first element 3 and/or the upper surface 10 of another slide 7.

Figure 3:
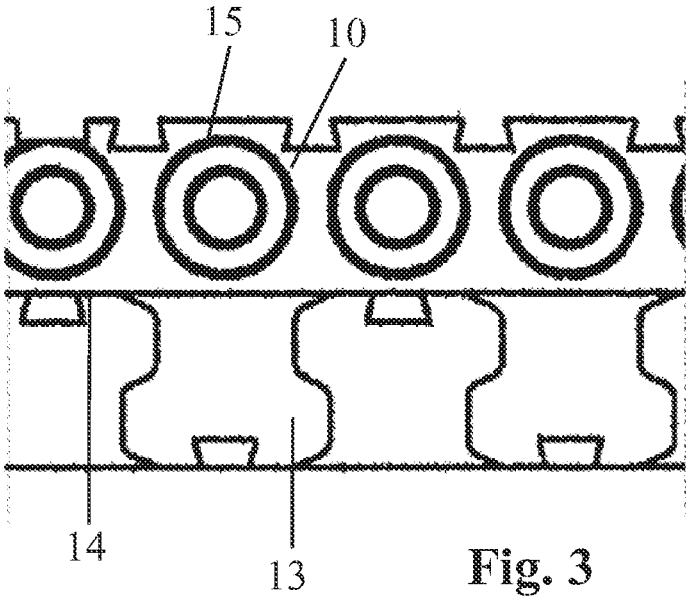
FIG. 3 is a front view of the upper surface of the slide.
Figure 4:
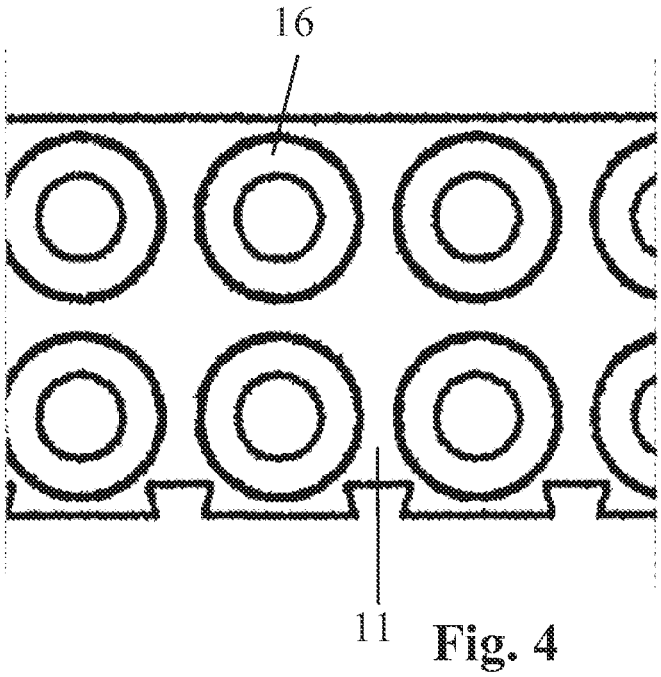
FIG. 4 is the opposite of the view of FIG. 3, and represents the other front surface of the slide.
Figure 5:
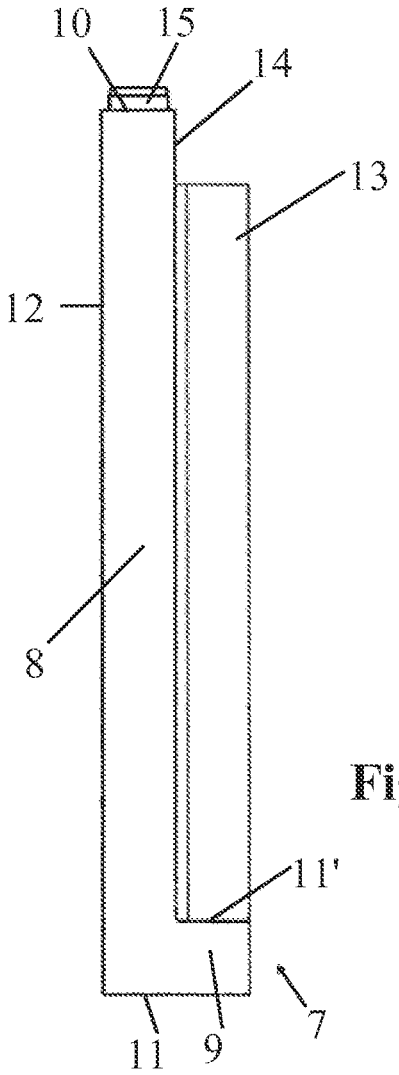
FIG. 5 is a side view of the slide.
Figure 6:
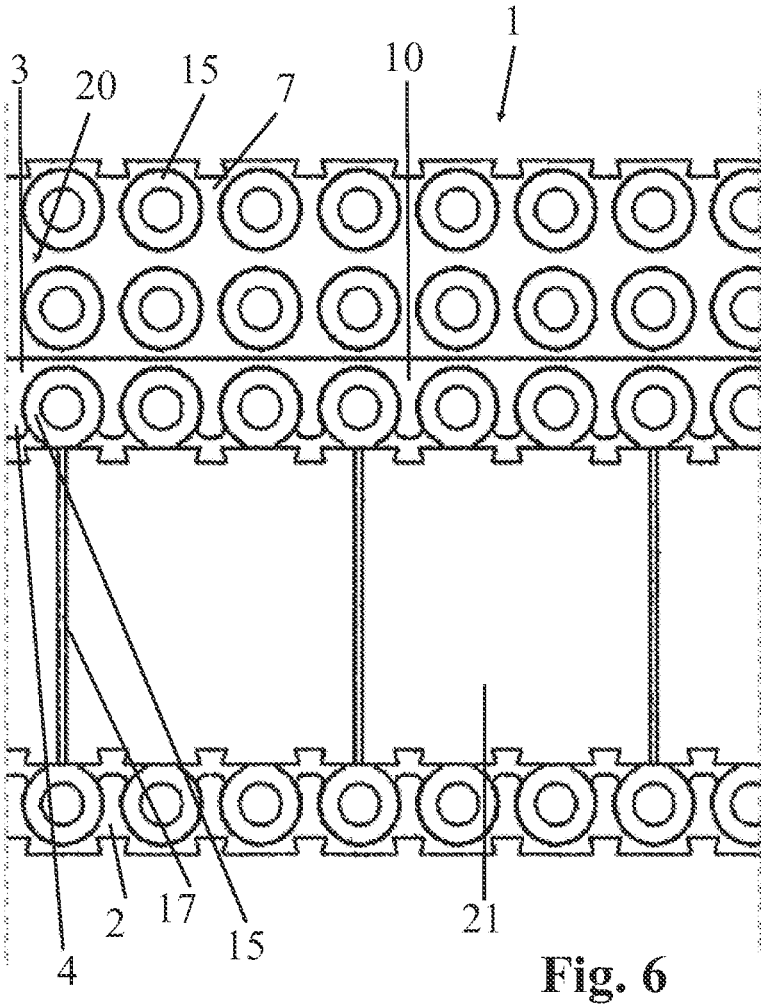
FIG. 6 is a front view of the formwork block according to the invention.
Figure 7:
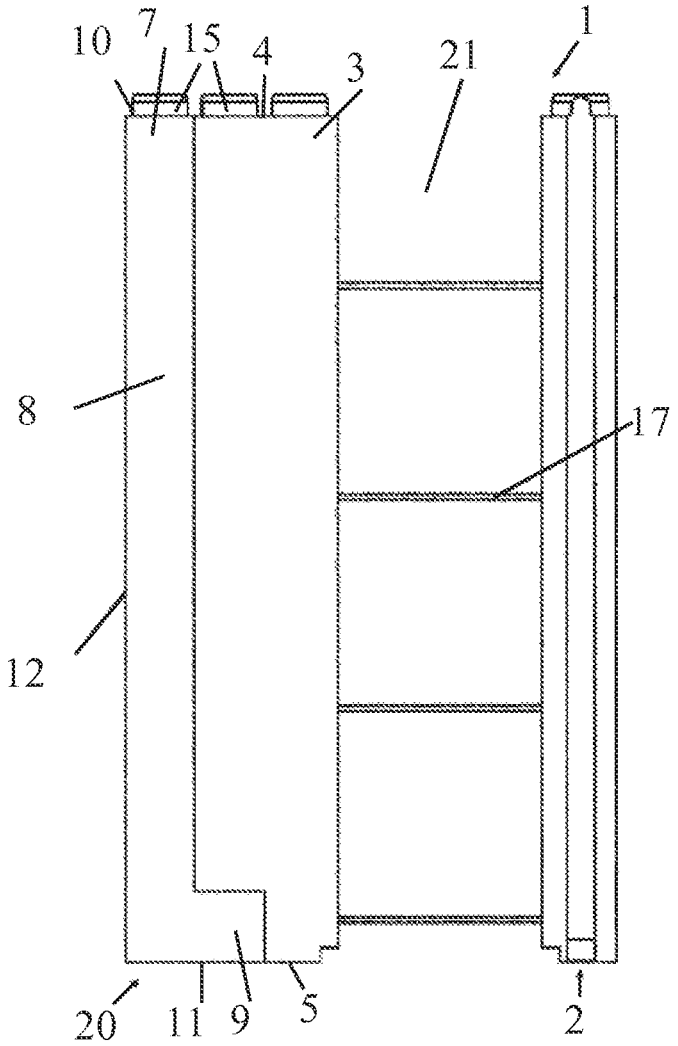
FIG. 7 is a side view corresponding to FIG. 6.

According to another possible additional characteristic, the slide 7 has an L shape for its entire width, that is, in a horizontal direction parallel to the wall formed by a stacking of insulating formwork blocks 1. Thus, once the insulating formwork block 1 has been installed, the cross section undergoing a vertical shearing is a maximum, allowing for the weight of the cladding on the outer surface 12 of the slide 7, and corresponds to the height of the second branch 9 of the L that constitutes the slide 7, that is, to its dimension measured perpendicularly to the lower surface 11, for the entire width of said block, that is, the total distance in the right to left direction in FIG. 1, 3 or 4, which contributes to the mechanical stability. The latter is also improved by the fact that, thanks to this characteristic, when insulating formwork blocks 1 are arranged in a stack, the contact occurring in the area of the lower surface 11 of the slide 7 of a first insulating formwork block 1 and with the upper surface 4 of the first element 3, as well as with the upper surface 10 of the slide 7 of a second insulating formwork block 1 located underneath, extends for the entire width of said first insulating formwork block 1, that is, its horizontal dimension parallel to the wall formed by said stacking.

According to yet another possible additional characteristic, a second horizontal branch 9 of the L or the horizontal branch of the L does not emerge from the first element 3, so that the space 21 is delimited, on the one hand, by the first element 3, and on the other hand by the inner wall 2. The recess 18, accommodating the second horizontal branch 9 of the L creating the slide 7, does not emerge into the space 21. Thus, the space 21 in which the material is poured is delimited by one surface of the first element 3, regardless of whether or not the slide 7 is present. The slide 7 thus does not contribute in any way to the tightness of the space 21, but is separated from the latter by the first element 3, both in the area of the first branch 8 of the L and the second branch 9 of the L. This limits the risk of leakage or spillage outside the space 21, particularly when the insulating formwork block 1 is cut, for example, to form window openings, and it also helps limit the cold bridges created by discontinuities in the surfaces delimiting the space 21.

The outer wall 20 thus has a total thickness, measured perpendicular to the inner wall 2, that is greater than the slide 7, that is, in particular, than the second branch 9 of the L, which contributes to the insulation by means of the insulating formwork block 1, thanks to a greater thickness of the outer wall 20.

Thanks to the invention, it is thus possible, when building a formwork for a vertical wall, to place an insulating formwork block 1 on a single first element 3, and this without using a support batten for the excess thickness that forms the slide 7, and also to place insulating formwork blocks 1 one on another without providing a specific support for the slide 7, since the latter is wedged between the first element 3 of the insulating formwork block 1 of which it is a part and another insulating formwork block 1. Furthermore, when the insulating formwork block 1 is placed on a flat surface, the slide 7 and the first element 3 form, in turn, a flat support surface to accommodate another insulating formwork block 1 in stable and flat manner.

Thus, after being installed, on the one hand the lower surface 11 of the slide 7 is situated at the level of the lower surface 5 of the first element 3, and on the other hand the upper surface 10 of the slide 7 is situated at the level of the upper surface of the first element 3. However, the upper surface 4 of the first element 3 can be above or below its lower surface 5. In the first case, the installation of the slide 7 on the first element 3 corresponds to a movement produced from bottom to top. In the second case, it corresponds to a movement from top to bottom.

Of course, the invention is not limited to the embodiment described and represented in the appended drawings. Modifications remain possible, especially from the standpoint of the makeup of the various elements or by substitution of equivalent techniques, without thereby leaving the scope of protection of the invention.

What is claimed is:

1. An insulating formwork block, comprising:

an inner wall; and an outer wall connected to the inner wall by a reinforcement, the outer wall being thicker than the inner wall, wherein the outer wall is composed of a first element, fixed to the inner wall, and a second element of insulating material, the second element configured to slidably couple to the first element by a slider connection, the entire second element having an L shape, wherein the first element has a shape complementary to the L shape of the second element such that the second element can slide against the first element by a vertical branch of the L shape second element, until it is locked by a horizontal branch of the L shape second element abutting the first element, wherein the horizontal branch of the second element extends into a recess of the first element having a corresponding complementary shape, and wherein the horizontal branch of the second element and the recess of the first element are configured such that when the horizontal branch of the second element is locked in abutment with the first element, a lower surface of the second element defined by the horizontal branch and a lower surface of the first element are situated in a same plane.

2. The insulating formwork block according to claim 1, wherein the second element of insulating material is constituted of a foam.

3. The insulating formwork block according to claim 1, wherein the second element is made of a different material than that used for forming the first element.

4. The insulating formwork block according to claim 1, wherein the second element, is delimited, at an upper part of the vertical branch of the L shape second element, by an upper surface, and at a lower part of the vertical branch, corresponding to the horizontal branch of the L shape second element, by the lower surface, these two surfaces being joined by a vertical outer surface, the lower surface of the second element having a length greater than that of the upper surface of the second element, and an inner surface of the vertical branch of the L shape second element, perpendicular to the upper surface of the second element and parallel to the outer surface, extends as far as a horizontal wall, parallel to the lower surface of the horizontal branch of the L shape second element and determining a thickness of the latter.

5. The insulating formwork block according to claim 1, wherein the slider connection includes complementary dovetail connection components on an inner surface of the second element and an outer surface of the first element, in a plane of which a translatory movement is allowed.

6. The insulating formwork block according to claim 1, wherein a total height of the first element is equal to a height of the second element, and thus corresponding to a length of the vertical branch of the L shape second element.

7. The insulating formwork block according to claim 1, wherein an upper surface of the second element and an upper surface of the first element have a first geometrical pattern, able to cooperate with a second geometrical pattern arranged on the lower surface of the second element and the lower surface of the first element.

8. The insulating formwork block according to claim 1, wherein the horizontal branch of the L shape second element does not emerge from the first element, so that a space is delimited, on the one hand, by the first element, and on the other hand by the inner wall.

9. The insulating formwork block according to claim 3, wherein the second element is made of a material that has less mechanical strength than material used for the first element.

10. The insulating formwork block according to claim 6, wherein the total height is measured by a distance separating the lower surface and a upper surface of the first element, and wherein the length of the vertical branch of the L shape second element is measured by a distance separating the lower surface and a upper surface of the second element.

* * * * *